United States Patent [19]

Achter et al.

[11] Patent Number: 4,827,189

[45] Date of Patent: May 2, 1989

[54] SOLDER CONNECTION FOR AN ELECTRODE OF THE GAS DISCHARGE LAMP AND THE METHOD FOR MANUFACTURE

[75] Inventors: Eugen Achter, Trebur; Michael Lausch, Taunstein, both of Fed. Rep. of Germany

[73] Assignee: Heimann GmbH, Fed. Rep. of Germany

[21] Appl. No.: 183,294

[22] Filed: Apr. 11, 1988

Related U.S. Application Data

[63] Continuation of Ser. No. 894,654, Aug. 8, 1986, abandoned.

[30] Foreign Application Priority Data

Aug. 29, 1985 [DE] Fed. Rep. of Germany ..... 3530921

[51] Int. Cl.[4] ..... H01J 61/04; H01J 61/36; H01J 9/24

[52] U.S. Cl. ..... 313/623; 313/331; 445/29

[58] Field of Search ..... 313/623, 625, 633, 331, 313/332, 333, 335; 445/26, 29, 43, 56

[56] References Cited

U.S. PATENT DOCUMENTS

| | | | |
|---|---|---|---|
| 2,630,471 | 3/1953 | Peters | 313/623 X |
| 4,203,050 | 5/1980 | Rech et al. | 313/220 |
| 4,236,045 | 11/1980 | Van der Plas et al. | 313/331 X |

FOREIGN PATENT DOCUMENTS

| | | |
|---|---|---|
| 2734099 | 2/1979 | Fed. Rep. of Germany . |
| 3227280 | 1/1984 | Fed. Rep. of Germany . |
| 2124822 | 2/1984 | United Kingdom . |

*Primary Examiner*—Kenneth Wieder

*Attorney, Agent, or Firm*—Hill, Van Santen, Steadman & Simpson

[57] ABSTRACT

The present invention is directed to a improved gas discharge lamp particularly for use as flash bulbs or lamps, wherein two tungsten electrodes are fused into a glass tube. In order for the lead to be soldered to an outer end of each of the tungsten electrodes with a soft solder, the outer ends of the electrodes are provided with a coating of a refractory solder, such as a hard solder or brazing compound. The coating, which has a melting point approximately at the point of fusion for the glass tube, can be applied during the step of fusing the electrodes into the glass tube.

3 Claims, 1 Drawing Sheet

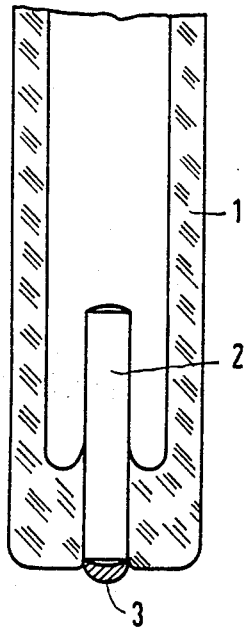
1
2
3

SOLDER CONNECTION FOR AN ELECTRODE OF THE GAS DISCHARGE LAMP AND THE METHOD FOR MANUFACTURE

This is a continuation of application Ser. No. 894,654, filed Aug. 8, 1986, abandoned.

BACKGROUND OF THE INVENTION

The invention is directed to a gas discharge lamp comprising a glass tube in which electrodes composed of a metal having a high melting point are fused and also to a method for manufacturing the gas discharge lamp.

Gas discharge lamps of this type are employed, for example, as flash bulbs or tubes. It is, therefore, necessary to electrically connect the leads from a power source to the electrode ends which ends project outside of the glass tube. For this purpose, pins composed of a soft-solderable material, for example composed of nickel or a nickel alloy, can be welded to the electrodes which, in particular, are composed of tungsten. The leads are then capable of being soldered to these pins with the assistance of a soft solder. The welding of such soft-solderable pins to the electrodes, however, means a considerable outlay in the terms of production technology.

SUMMARY OF THE INVENTION

The object of the present invention is to provide a gas discharge lamp of the type having a tungsten electrode extending through a glass tube which is simple to manufacture and which electrode has a problem-free solder connection to the leads which connection can be produced with the assistance of soft solder.

This object is achieved by an improvement in gas discharge lamp comprising a glass tube in which an electrode composed of a metal having a high melting point is fused. The improvement is that the a refractory solder is applied to the outer end of the electrode.

The method of manufacturing the improved gas discharge lamp occurs in that the electrodes are fused into the glass tube and a member composed of the refractory solder is brought into contact with the outer end of the electrode. The melting point of the refractory solder is roughly the same as the melting point for the glass tube and after the conclusion of the fusing process, the refractory solder will have formed a coating on the outer end of the electrode.

The manufacture of the gas discharge lamp of the invention ensures that when the electrodes are fused into the glass tube, a member composed of the refractory solder is brought together with the outer end of the electrode and the melting point of this solder is roughly the same as the melting point of the glass. When the glass then reaches its melting point, the member of hard solder or brazing material will be fused to coat the outer end of the electrode.

BRIEF DESCRIPTION OF THE DRAWINGS

The FIGURE is a cross sectional view with portions in elevation for purposes of illustration of an end of a discharge lamp in accordance with the present invention.

DESCRIPTION OF THE PREFERRED EMBODIMENTS

The principles of the present invention are particularly useful when incorporated into a glass discharge lamp having a glass tube 1 in which two tungsten electrodes are fused. As illustrated, a tungsten electrode 2 is shown extending through an end of the glass tube 1.

For forming the electrical connection of the illustrated glass discharge tube to a lead, a member composed of a refractory solder is brought together with an outer end of the tungsten electrode 2 when the tungsten electrode 2 is being fused into the glass tube 1. This member melts and thereby forms a coating 3 which is solderable with a soft solder. The same coating is produced on the second tungsten electrode which would be positioned at the other end of the tube forming the discharge lamp.

A tungsten-wetting hard solder or brazing material comes into consideration as a refractory solder for performing the present invention.

Although various minor modifications may be suggested by those versed in the art, it should be understood that we wish to embody with the scope of the patent granted hereon, all such modifications as reasonably and properly come witin the scope of our contribution to the art.

An example of such a refractory solder is Ag Cu 28 Ni 5 i.e. a solder with 28% Cu, 5% Ni, rest Ag.

We claim:

1. In a gas discharge lamp having a glass tube in which electrodes composed of metal having a high melting point are fused into the glass tube with a metal-to-glass seal and with each electrode having an outer exposed end, the improvement comprising a coating of a refractory solder with a melting point roughly the same as the melting point of the glass tube being applied to the outer exposed end of each electrode to form a point for a subsequent solder connection of the electrode to a lead.

2. In a gas discharge lamp according to claim 1, wherein said electrode is composed of tungsten and said coating of a refractory solder is a tungsten-wetting brazing material.

3. A method for manufacturing a gas discharge lamp having an electrode of a metal with a high melting point being fused in the end of a glass tube of the lamp with the exposed end of the electrode being coated with a refractory solder to form a point for a subsequent solder connection to a lead, said method comprising the steps of positioning the electrode in the glass tube, heating the glass tube to fuse the glass tube to connect the electrode in the glass tube and while heating the glass tube, bringing a member composed of a refractory solder in contact with an outer end of the electrode, said refractory solder having a melting point roughly the same as the melting point of the glass so that during the fusing of the glass a coating of the refractory solder is formed on the outer end of the electrode.

* * * * *